United States Patent [19]

Sakong

[11] Patent Number: 4,883,314

[45] Date of Patent: Nov. 28, 1989

[54] FOLDING TABLE AND SEAT ASSEMBLY

[76] Inventor: Chul H. Sakong, 11 Nowon-Dong, 3-Ka, Buk-Ku, Daegu, Rep. of Korea

[21] Appl. No.: 182,082

[22] Filed: Apr. 15, 1988

[51] Int. Cl.[4] ..... A47B 39/00

[52] U.S. Cl. ..... 297/159; 108/36; 108/160; 248/188.5

[58] Field of Search ..... 108/160, 36; 297/159, 297/157, 158; 248/423, 439, 188.5; 403/90, 109, 328; 16/110 R; 383/15

[56] References Cited

U.S. PATENT DOCUMENTS

| | | | |
|---|---|---|---|
| 2,771,261 | 11/1956 | Niggeloh | 248/188.5 |
| 3,146,737 | 9/1964 | De Saussure | 108/160 |
| 3,659,776 | 5/1972 | Suominen | 383/15 |
| 4,052,100 | 10/1977 | Nikitits et al. | 297/159 |
| 4,101,164 | 7/1978 | Urdanoz | 297/159 |
| 4,111,482 | 9/1978 | Jones | 297/159 |
| 4,249,773 | 2/1981 | Giambalvo | 297/159 |
| 4,653,804 | 3/1987 | Yoo et al. | 108/160 |

*Primary Examiner*—James T. McCall

*Attorney, Agent, or Firm*—Birch, Stewart, Kolasch & Birch

[57] ABSTRACT

A combined table and seat assembly which comprises a table top including two pivotally attached table top halves and seat members pivotally attached thereto, whereby the assembly is collapsible into a self-contained carrying case composed of the table top for providing a readily portable, stable, operational, and simple folding table and seat assembly.

4 Claims, 6 Drawing Sheets

FOLDING TABLE AND SEAT ASSEMBLY

BACKGROUND OF THE INVENTION

1. Field of Invention

The present invention relates to a combined table and seat assembly and more particularly, to a combined folding table and seat assembly which is collapsible into a self-contained carrying case. Most particularly, the present invention relates to folding table and seat assemblies which include connecting members connected to the table and seat, and safety pins engaged in leg supports of the seat for providing a readily portable, stable, and simple folding table and seat assembly.

2. Description of Prior Art

Combined table and seat assemblies are known which are structured with a folding table and seat, which are collapsible into a self-contained carrying case. Such table and seat assemblies are shown in U.S. Pat. Nos. 4,052,100, 4,101,164, 4,111,482, 4,249,773 and 4,653,804. However, there are many problems with the prior art table and seat assemblies, for example, it is very difficult to handle such assemblies because the structures are very complicated, and are unstable.

SUMMARY OF THE INVENTION

Accordingly, it is an object of the present invention to provide an improved, combined table and seat assembly which is collapsible into a self-contained carrying case.

Another object of the present invention is to provide a folding table and seat assembly which includes table support members having connecting members with bent bars, respectively for a seat assembly which is effectively stabilized when the assembly is opened.

A further object of the present invention is to provide a seat member of a table and seat assembly which includes fixing pins and tensible ring members disposed in seat support members for effectively stabilizing the seat member when the assembly is opened.

Still another object of the present invention is to provide a table and seat assembly which includes a pair of hinge plates for preventing the opened table top from bending.

Yet another object of the present invention of the present invention is to provide a combined table and seat assembly which includes a handle member having locking members for effectively locking when the assembly is collapsed in the self-contained case.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a combined table and seat assembly which comprises connecting support members having bent bars, tensible ring members, fixing pins, hinge plates, and locking members on the handle members whereby the assembly is collapsible into a self-contained carrying case composed of the table top for providing a readily portable, stable, operational, and simple folding table and seat assembly.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
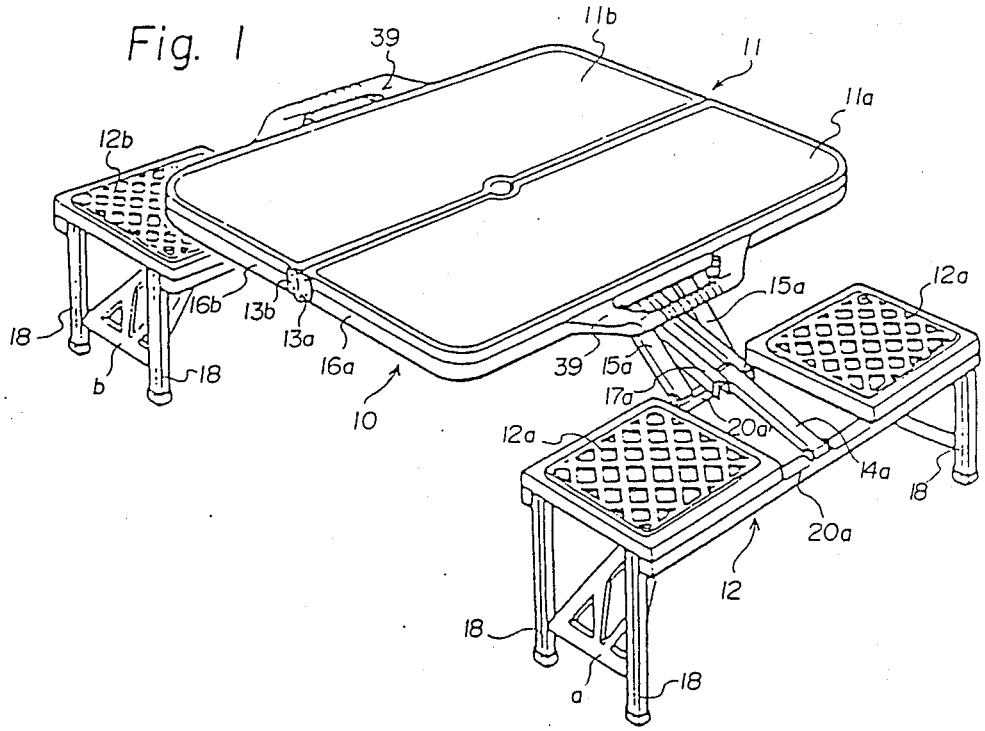
FIG. 1 is a perspective view of a fully unfolded table of the present invention.
Figure 2:
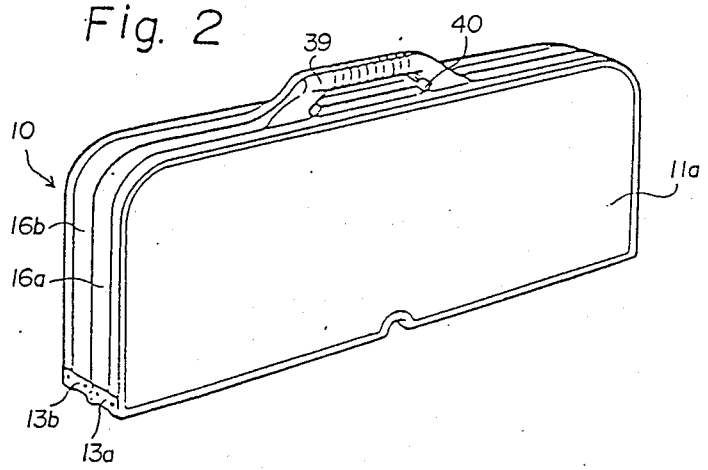
FIG. 2 is a perspective view of a carrying case formed by folding up the table of the present invention.
Figure 11:
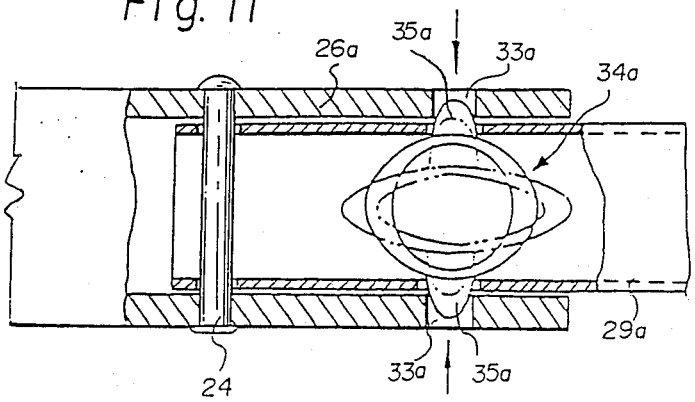
FIG. 11 is a sectional view of a tensible ring member disposed within tubular upper arm of the present invention.
Figure 12:
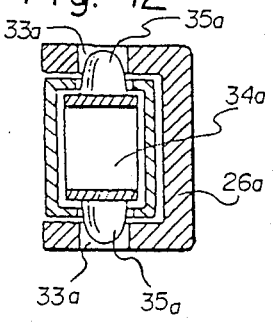
FIG. 12 is a cross-sectional view of a tensible ring member disposed with a tubular upper member of the present invention.
Figure 3:
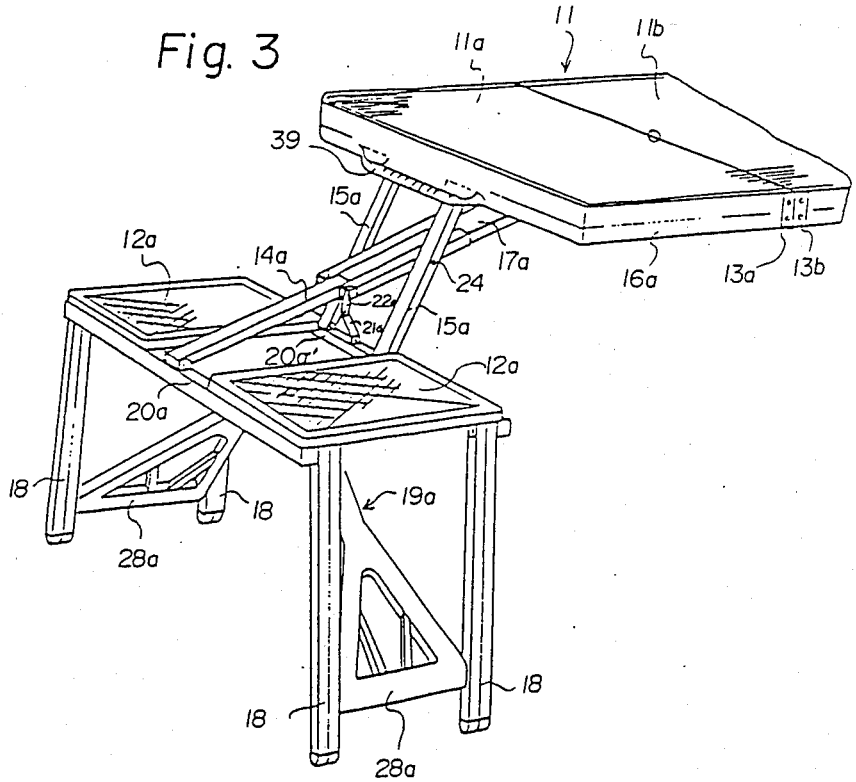
FIG. 3 is a perspective view of a portion of a table and seat connected by means of table support members of the present invention.
Figure 4:
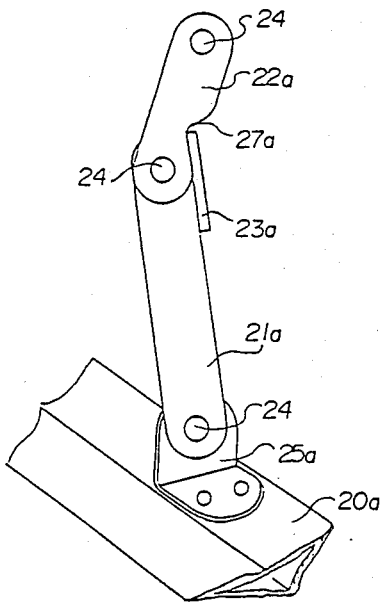
FIG. 4 is an enlarged perspective view of assembled connecting members of the present invention.
Figure 5:
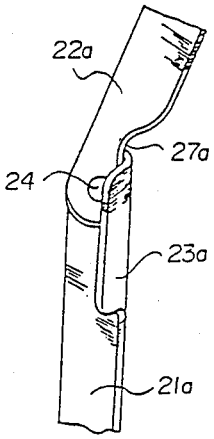
FIG. 5 an enlarged side view of the center portion of connecting members with a bent bar of the present invention.

Referring now in detail to the drawings for the purpose of illustrating preferred embodiments of the present invention, a combined table and seat assembly 10 as shown in FIGS. 1 and 2 comprises a table 11 having two identical table top halves **11*a* and 11*b* which are pivotally connected to one another at their abutting side edges by way of a pair of hinge plates 13*a* and 13*b*, and seat assemblies 12 including a pair of seats 12*a* and 12*b*, respectively. The seat assemblies 12 are connected to the table halves 11*a* and 11*b* by table support members 14*a* and 14*b* and extending table support members 17*a* and 17*b*, and by a pair of auxiliary table support members 15***a* and 15*b*, respectively. The pair of auxiliary table support members 15*a* and 15*b* are connected with the extending table support members 17*a* and 17*b* by pivot pins 24, respectively.

Each of table top halves 11*a* and 11*b* includes downwardly extending peripheral walls 16*a* and 16*b*, which define hollow regions underneath each of the table top halves 11*a* and 11*b*, respectively. The hollow regions acting as containers for the seat assemblies 12 when these seat assemblies 12 are collapsed as will be described in more detail hereinafter. The table 11 is made of plastic, fiberglass, or the like.

Figure 6:
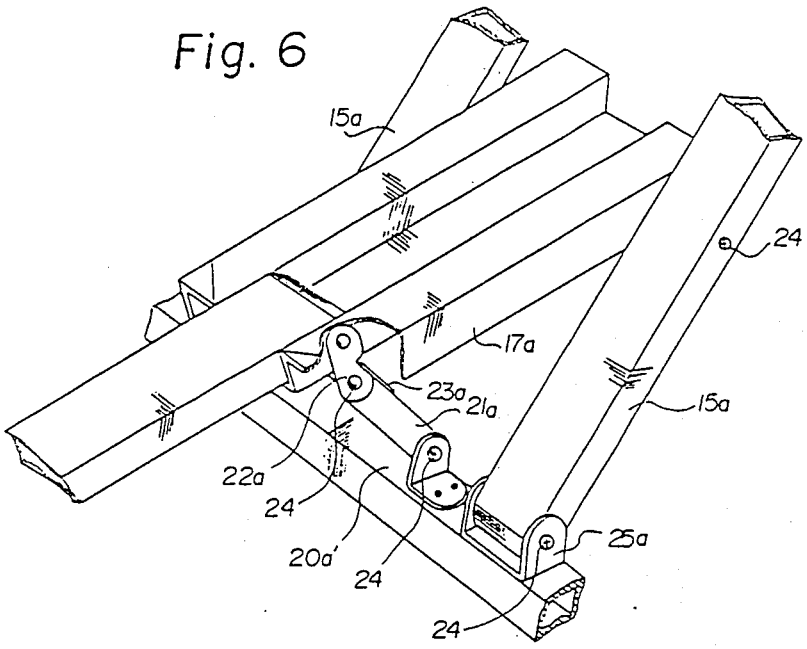
FIG. 6 is a perspective view of assembled table support members of the present invention.
Figure 7:
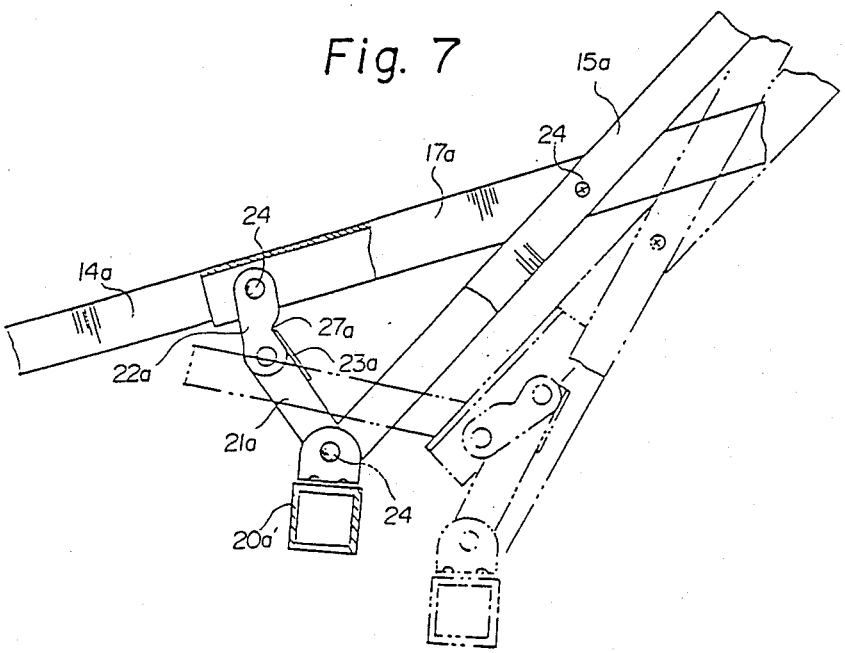
FIG. 7 is a perspective view of table support members of the present invention showing the movement thereof.

As shown in FIGS. 3–7, the seat assemblies 12 include legs 18, a pair of seat support members 19*a* and 19*b*, inside and outside frames 20*a* and 20*a'*, 20*b* and 20*b'*, and the pair of seats 12*a* and 12*b* disposed in the seat assemblies 12, respectively. First connecting members 21*a* and 21*b* pivotally extend to second connecting members 22*a* and 22*b* by pivot pins 24 for connecting between the inside frames 20*a* and 20*b*, and the first table support members 14*a* and 14*b*. The first and second connecting members 21*a*, 21*b*, 22*a* and 22*b* are pivotally secured to the first table support members 14*a* and 14*b* and to joint members 25*a* and 25*b* by pivot pins 24, which are mounted to the inside frames 20*a* and 20*b* of the seat assemblies 12. Bent bars 23*a* and 23*b* are attached to the first connecting members 21*a* and 21*b*, respectively. The second connecting members 22*a* and 22*b* include slots 27*a* and 27*b* for operatively engaging one end of the bent bars 21*a* and 21*b*, respectively, to protect the second connecting members 22*a* and 22*b* from bending about the bent bars 23*a* and 23*b*, respectively (FIG. 7). Also, the first table support members 14*a* and 14*b* can be arranged in parallel with the second table support members 15*a* and 15*b*, respectively, when the seat assemblies 12 are collapsed into a carrying case composed of the table top halves 11*a* and 11*b*. The pair of second table support members 15*a* and 15*b* are pivotally secured to the inside frames 20*a* and 20*b* of the seat assemblies 12 by pivot pins 24 through joint members 25*a* and 25*b*, respectively (FIG. 6).

Figure 8:
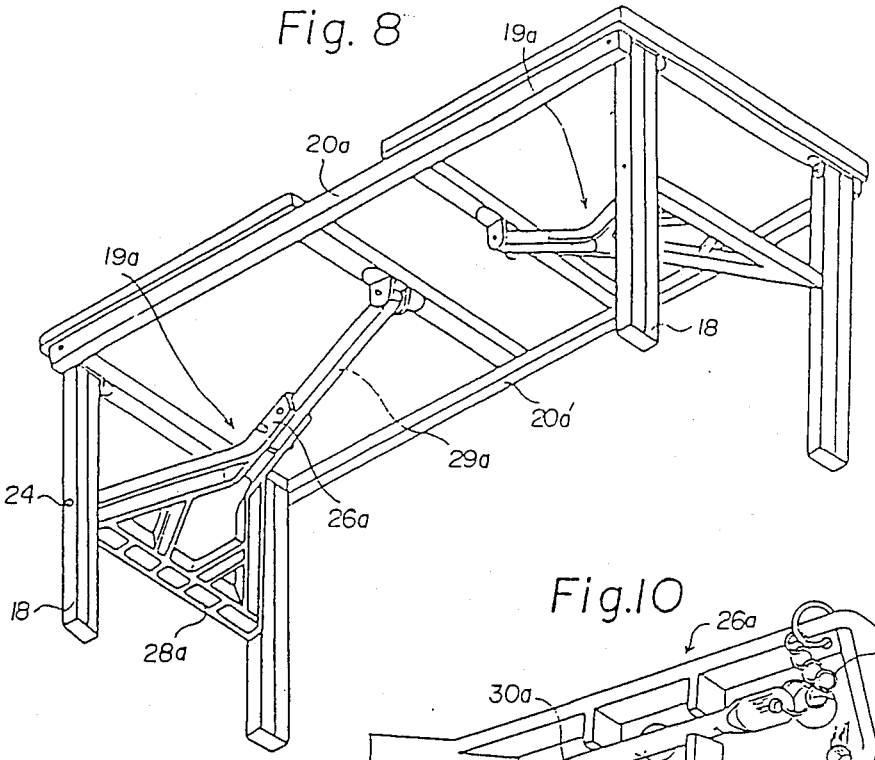
FIG. 8 is a perspective view of a frame of a seat assembly of the present invention.
Figure 10:
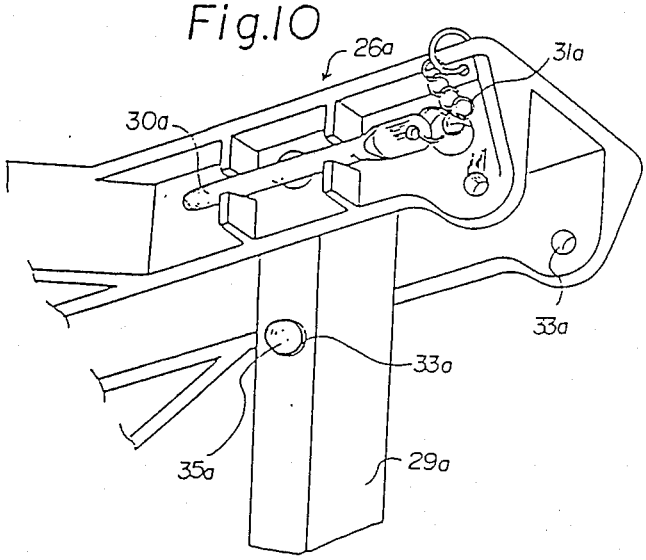
FIG. 10 is a perspective view of a seat support member of the present invention showing a fixing pin stored in engaging members of a channel member.
Figure 9:
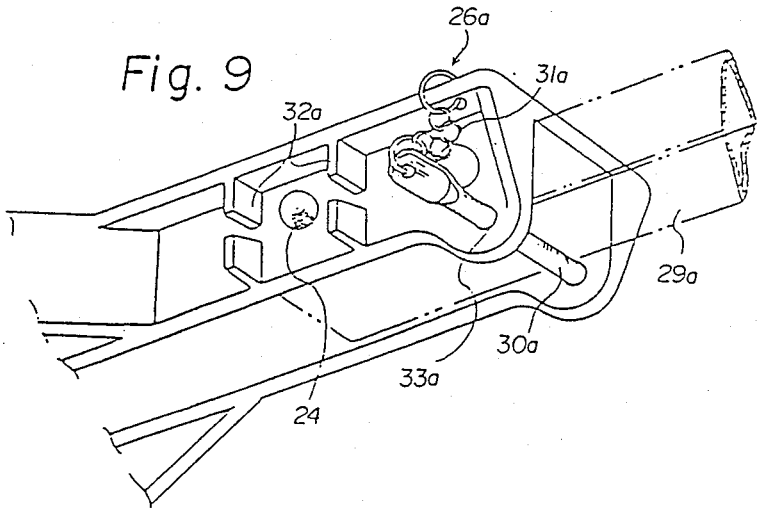
FIG. 9 is a perspective view of a seat support member of the present invention showing a fixing pin engaged in a pair of apertures of a channel member.

As shown in FIGS. 8–12, the pair of seat support members 19*a* and 19*b* are composed of channels 26*a* and 26*b* disposed at tip portions of lower arms 28*a* and 28*b* on three sides, and tubular upper arms 29*a* and 29*b* connected with the channels 26*a* and 26*b* by pivot pins 24, respectively. The other two sides of the lower arms 28*a* and 28*b* are connected to the pair of legs 18 of the seat assemblies 12 by pivot pins 24 through joint members 25*a* and 25*b*, respectively (FIG. 8). The channels 26*a* and 26*b* include, fixing pins 30*a* and 30*b* having chains 31 and 30*b*, respectively, for mounting the fixed pins thereto (FIG. 10). Also, the channels 26*a* and 26*b* further include engaging members 32*a* and 32*b* for engaging the fixing pins 30*a* and 30*b* therein, and apertures 33*a* and 33*b* for fixing the fixing pins 30*a* and 30*b* therein, respectively, when the seat assemblies 12 are fully opened from the folding table and seat assembly 10 (FIG. 9). Also, the tubular upper arms 29*a* and 29*b* contain tensible ring members 34*a* and 34*b* having a pair of projecting members 35*a* and 35*b* which may have an elliptical configuration, respectively. Therefore, when the folding table and seat assembly 10 are opened, the seat assemblies are effectively stabilized since the fixing pins 30*a* and 30*b* are engaged in the apertures 33*a* and 33*b* as well as the pair of projecting members 35*a* and 35*b* of the ring member 34*a* and 34*b* are tightly engaged in the apertures 33*a* and 33*b* due to tensibility, for protecting the tubular upper arms 29*a* from bending toward the channels 26*a* and 26*b*, respectively. Also, when the seat assemblies 12 are collapsed into the self-contained carrying case, the fixing pins 30*a* and 30*b* are removed from the apertures 33*a* and 33*b* of the channels 26*a* and 26*b* of the lower arms of 38*a* and 28*b*, respectively.

Figure 13:
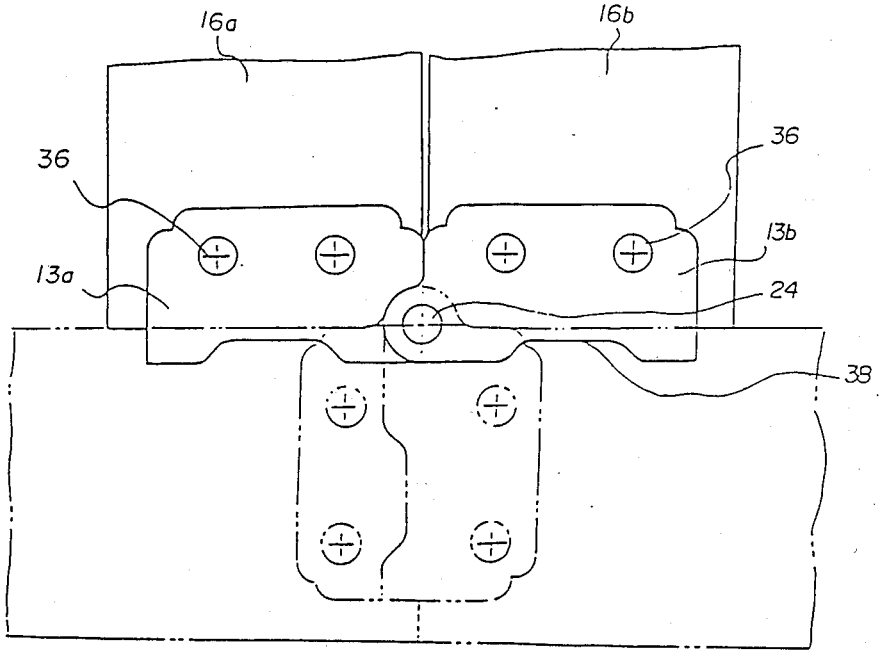
FIG. 13 is an enlarged front view of a hinge plate attached on walls of the bag, after folding, of the present invention.
Figure 14:
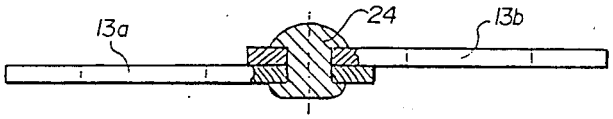
FIG. 14 is a cross-sectional view of FIG. 13, taken along line 14—14.

As shown in FIGS. 13 and 14, the pair of hinge plates 13*a* and 13*b* include a plurality of bolts 36 for mounting the hinge plates to edge portions of the walls 16*a* and 16*b*, respectively, and pivot pins 24 for pivotally engaging the hinge plates 13*a* together at the corners thereof, respectively, (FIG. 14).

Figure 18:
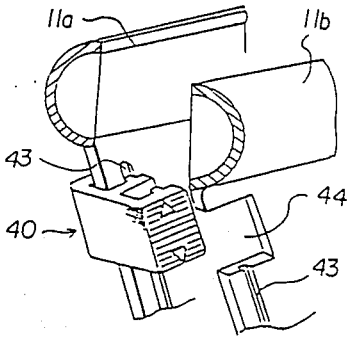
FIG. 18 is a perspective view of a locking member disposed on a handle of the present invention showing the movement thereof.
Figure 15:
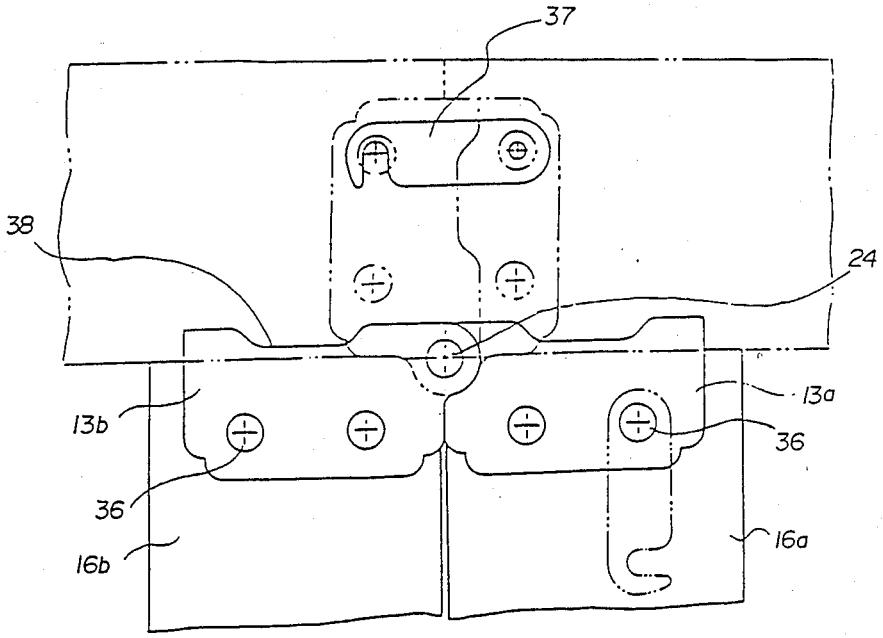
FIG. 15 is an enlarged front view of a hinge plate having a hook member attached on walls of the bag, after folding, of the present invention.
Figure 16:
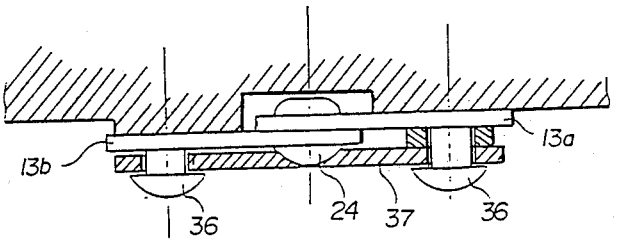
FIG. 16 is a cross-sectional view of FIG. 15, taken along line 16—16.

Referring in detail to FIGS. 15 and 18, there is illustrated an additional embodiment of a hinge plate in accordance with the present invention. Hook members 37 are pivotally attached to the bolt 36 for locking the other bolt 36 (FIG. 16). The hinge plates 13*a* and 13*b* include a plurality of grooves 38 disposed in the lower edges thereof for functioning as a foot pad.

Figure 17:
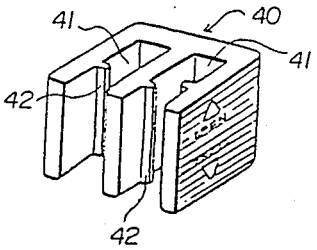
FIG. 17 is a perspective view of a locking member disposed on a handle of the present invention.

As shown in FIGS. 2, 17 and 18, the folding table and seat assembly 19 is provided with a handle 39 composing handle halves 39*a* and 39*b* and locking members 40. The locking member 40 has hollow portions 41 and a plurality of protrusions 42 for operatively engaging a plurality of vertical grooves 43 disposed in the surface of one handle half 39*a* with grooves 43 disposed in the surface of the other handle half 39*b*, wherein the seat half 39*b* includes a rectangular groove 44 for releasing the locking member 40 from the seat half 39*b* when the assembly 10 is opened (FIG. 18).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A folding table and seat assembly collapsible into a self-contained carrying case which comprises:

a table including two pivotally attached table top halves for opening and folding together, seat assemblies including an inside frame portion nearer to said table and an outside frame portion further from said table, wherein said seat assemblies are operatively connected to said table for opening up and collapsing into said table top halves, and said seat assemblies include a plurality of legs pivotally attached thereto, table support assemblies for connecting said table to said seat assemblies, said table support assemblies each including:

a first table support member pivotally connected to said outside frame, said first table support member extending to support said table from said seat assemblies, and a pair of second table support members pivotally connected to both sides of said first table support member and to said inside frame, table support connecting members operatively connecting said first table support member to said seat assemblies, said table support connecting members each including:

a first connecting member pivotally connected to said inside frame, and a second connecting member pivotally connected to said first table support member and said first connecting member, wherein said first connecting member has a bent flange and said second connecting member has a slot for receiving said bent flange, seat support members formed in said seat assemblies and including a lower arm pivotally connected between a pair of said legs and a tubular upper arm pivotally connected to said lower arm and to said seat, said lower arm has a channel for operatively receiving said tubular upper arm, tensible ring members having an elliptical configuration and a pair of projecting members disposed within said tubular upper arm for operatively engaging said pair of projecting members in a pair of apertures disposed in the tubular upper arm, fixing pins mounted to said channel of the lower arm for tightly engaging in a pair of apertures disposed in the channel when the seat member is opened, hinge plates, attached to edge portions of said table, having pivot pins for pivotally moving said table top halves in open and closed positions, said hinge plates each including a hook member for locking one hinge plate together with the other hinge plate, handle members mounted on said table top halves, and a pair of locking members slidably attached to said handle members for locking said handle members together, said locking member including a hollow member which has a pair of vertical protrusions disposed therein for locking in a pair of vertical grooves disposed in the surface of handle portions of said table, whereby the folding table and seat assembly is readily portable for hand-carrying when collapsed, stable when opened and assembled for use, and simple to manufacture.

2. The folding table and seat assembly of claim 1, wherein pivot pins are used in said table support members, said connecting members, and said seat support members.

3. The folding table and seat assembly of claim 1, wherein the fixing pin is mounted by a chain to the channel.

4. The folding table and seat assembly of claim 1, wherein the locking member is provided with a rectangular groove disposed in the surface of handle portion of one of table top halves.

* * * * *